US007570545B2

(12) United States Patent
Journe

(10) Patent No.: US 7,570,545 B2
(45) Date of Patent: Aug. 4, 2009

(54) PUSHBUTTON DEVICE FOR CONTROLLING THE START/STOP AND RESETTING FUNCTIONS OF A CHRONOGRAPH MECHANISM

(75) Inventor: Francois-Paul Journe, Geneva (CH)

(73) Assignee: Montres Journe S.A., Geneva (CH)

( * ) Notice: Subject to any disclaimer, the term of this patent is extended or adjusted under 35 U.S.C. 154(b) by 0 days.

(21) Appl. No.: 12/278,201

(22) PCT Filed: Jan. 30, 2007

(86) PCT No.: PCT/CH2007/000045

§ 371 (c)(1),
(2), (4) Date: Aug. 4, 2008

(87) PCT Pub. No.: WO2007/090307

PCT Pub. Date: Aug. 16, 2007

(65) Prior Publication Data

US 2009/0034373 A1 Feb. 5, 2009

(30) Foreign Application Priority Data

Feb. 8, 2006 (EP) ..... 06405058

(51) Int. Cl.
*G04F 8/00* (2006.01)
*G04B 29/00* (2006.01)

(52) U.S. Cl. ..... 368/108; 368/319

(58) Field of Classification Search ..... 368/101–106, 368/308, 319–321
See application file for complete search history.

(56) References Cited

U.S. PATENT DOCUMENTS 2,456,122 A * 12/1948 Guilden ..... 368/27
3,759,033 A 9/1973 Jeanmonod
3,890,779 A * 6/1975 Capt et al. ..... 368/103
4,106,282 A 8/1978 Larsson
4,364,674 A * 12/1982 Tesch ..... 368/319
2007/0153640 A1 7/2007 Saunier

FOREIGN PATENT DOCUMENTS

| | | | |
|---|---|---|---|
| CH | 30 216 | A | 11/1904 |
| CH | 1 386 575 | | 7/1977 |
| DE | 2 207 386 | A1 | 8/1972 |
| EP | 0 443 087 | A1 | 8/1991 |
| EP | 1 553 468 | A1 | 7/2005 |

OTHER PUBLICATIONS

International Search Report of PCT/CH2007/000045, date of mailing Sep. 6, 2007.
Notification of Transmittal of Translation of the International Preliminary Report on Patentability (Form PCT/IB/373) of International Application No. PCT/CH2007/000045 mailed Oct. 8, 2008 with Forms PCT/ISA/237.

* cited by examiner

*Primary Examiner*—Vit W Miska
(74) *Attorney, Agent, or Firm*—Westerman, Hattori, Daniels & Adrian, LLP.

(57) ABSTRACT

This pushbutton device for controlling the start/stop and resetting functions of a chronograph mechanism comprises two control pushbuttons able to slide between two limit positions, elastic return means which constantly tend to keep these pushbuttons in their outward limit positions, and a control rocker which pivots about a pivot. The control rocker is situated between the pushbuttons, the latter being, in their outward limit positions, simultaneously in contact with the control rocker, keeping it in a middle position between the limit positions of its pivoting, which correspond to the movement of the pushbuttons to their respective inward limit positions.

16 Claims, 1 Drawing Sheet

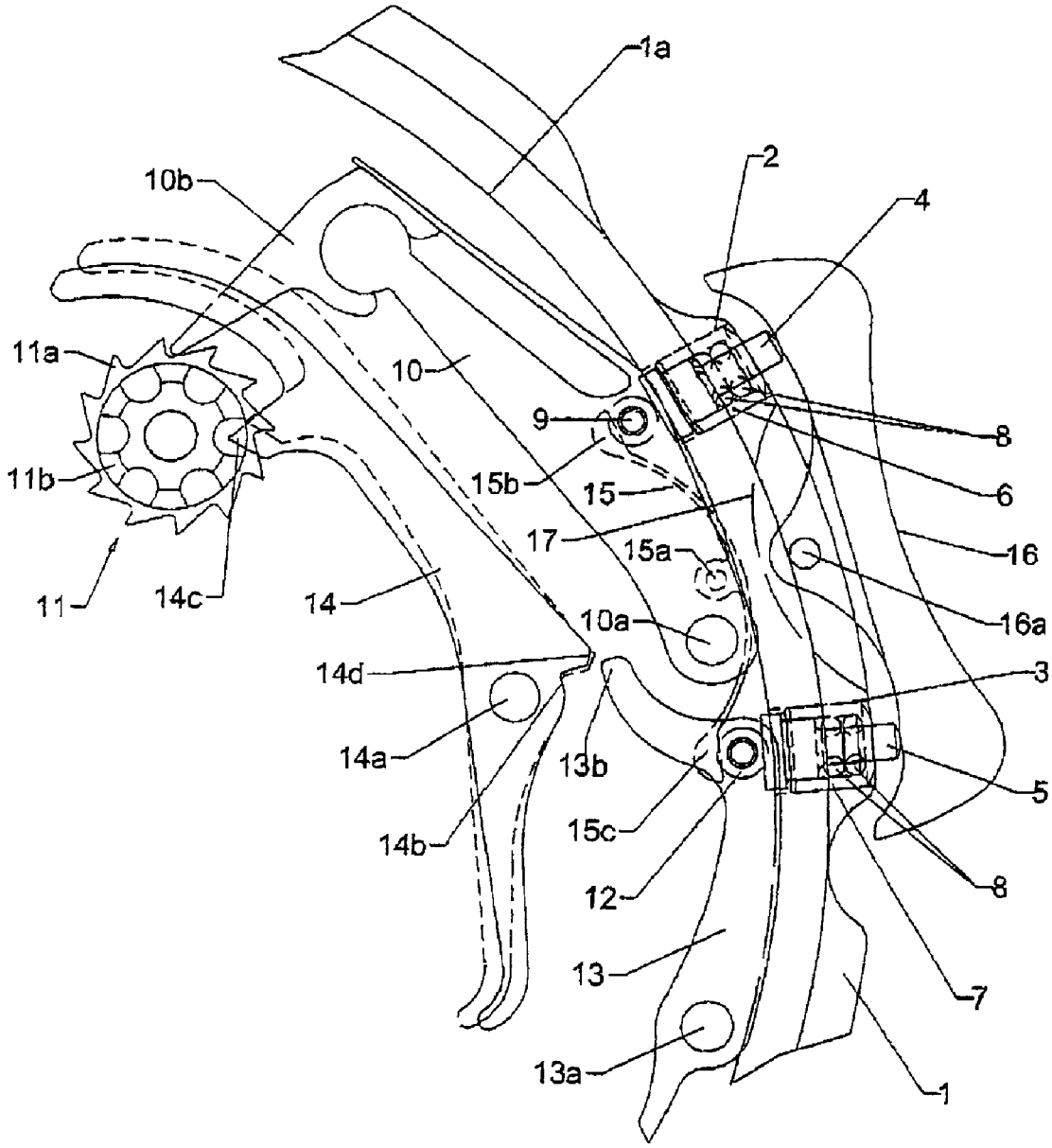
1a
2
4
10b
11a
10
9
8
11b
15b
15
6
17
15a
16
11
14c
14
10a
16a
14d
3
14a
13b
5
15c
14b
12
8
13
7
13a
1

PUSHBUTTON DEVICE FOR CONTROLLING THE START/STOP AND RESETTING FUNCTIONS OF A CHRONOGRAPH MECHANISM

The present invention relates to a pusher device for controlling the start/stop and zero-reset functions of a chronograph mechanism from outside a watch case, comprising a case middle whose main face is traversed by a central opening for receiving a timepiece movement and which has two lateral guide openings, the axes of which are parallel to the plane of the central opening and through which two control pushers are mounted so that they can slide between two limit positions, elastic return means tending constantly to maintain these pushers in their outer limit positions with respect to said central opening, corresponding to their rest positions, and a control rocker mounted on the lateral face of the case middle and hinged about a pin perpendicular to the plane of said central opening (1*a*) and remote from a pusher which is kinematically linked to this rocker between said two limit positions.

A rocker device for actuating a chronograph pusher has already been proposed in CH 30216 and in EP 0 443 087. Between its two limit positions, a rocker described in these documents allows only one pusher to be actuated, such that in a chronograph comprising two pushers each rocker actuates one of the two pushers, thus making it necessary to have two rockers.

The object of the present invention is not only to simplify this pusher device but also to simplify the actuation of the chronograph mechanism by the user.

Accordingly, the subject of this invention is a pusher device for controlling the start/stop and zero-reset functions of a chronograph mechanism from outside a watch case as claimed in claim 1.

By virtue of this device, the force exerted is reduced by the lever effect of the control rocker. Furthermore, the area of the rocker on which the pressure is exerted can be substantially greater than that exerted directly on the same pusher, with the result that the pressure per unit area on the finger is also smaller. Hence, the lever effect and the increased area combine to give a better level of comfort along with higher responsiveness of the control, thus contributing to improving the accuracy of the measurement carried out. Switching from one function of the chronograph to the other is achieved simply by reversing the rocking direction of the rocker from its rest position.

The appended drawing illustrates, schematically and by way of example, an embodiment of the pusher device forming the subject of the present invention.

The single FIGURE is a partial plan view of a chronograph mechanism and also of the middle of the protective case without the bottom.

This FIGURE shows a portion of a case middle 1 traversed by a central opening 1*a* for receiving the movement of the timepiece, in this example a chronograph movement. This case middle is additionally traversed by two lateral openings 2, 3 each serving as a guide opening for a respective control pusher 4, 5. In this example, each control pusher 4, 5 is accommodated in a respective sleeve 6, 7 fitted into the respective lateral opening 2, 3. Two O-rings 8 are accommodated around each portion of the control pusher 4, 5 that is situated in the respective sleeves 6, 7 so as to seal the control pushers 4, 5 passing through the case middle 1.

That end of the control pusher 4 situated inside the case 1 is in contact with a stud or a rod 9 projecting from a control lever 10 which is pivoted at one end 10*a* and provided at its opposite end with a finger 10*b* in engagement with a ratchet toothing 11*a* of a conventional start/stop control column wheel of the chronograph mechanism (not shown). This column wheel 11 is positioned by means of a pawl (not shown).

That end of the control pusher 5 situated inside the case is in contact with a stud 12 of a zero-reset control lever 13 which is pivotally mounted about a pin 13*a*. This zero-reset control lever 13 comprises a locking arm 13*b*. A locking lever 14 engaged against the columns 11*b* of the column wheel 11 by a spring (not shown) is pivotally mounted about a pin 14*a*. This locking lever comprises a finger 14*c* which is able either to engage between the columns 11*b* of the column wheel 11 or to bear on the columns 11*b*, as illustrated in the position depicted by broken lines. The position illustrated by a solid line corresponds to the stop position of the chronograph. In this position, the zero-reset lever 13 can be moved by the pusher 5 to come into a recess 14*b* of the locking lever 14.

When the column wheel 11 is moved by one step in the counterclockwise direction by the end 10*b* of the control lever 10, the finger 14*c* of the locking lever 14 is lifted into the position illustrated by broken lines. In this position, the locking lever 14, by turning, has brought a locking surface 14*d* opposite the end of the arm 13*b*, preventing the zero-reset lever from being actuated by the pusher 5.

A return spring 15 for the pushers 4 and 5 is held at its center 15*a*, and the two ends of its two symmetrical arms 15*b*, 15*c* respectively bear against the studs 9 and 12, thus each tending to return the levers 10 and 13 to a rest position and simultaneously tending to maintain the pushers 4, 5 in their respective rest positions in which they project outside the lateral guide openings 2 and 3.

A control rocker 16 is pivotally mounted about a pin 16*a* perpendicular to a plane containing the sliding axes of the two pushers 4 and 5 and situated substantially at an equal distance from these pushers, advantageously on a mid-line with respect to these pushers 4, 5 on which the mid-attachment of the return spring is also situated, ensuring perfect symmetry of the respective forces applied to the pushers 4 and 5 by the control rocker 16 and also by the arms 15*b*, 15*c* of the return spring 15 on the control rocker 16 in the rest position. This pivoting pin 16*a* is advantageously formed in a recess 17 situated within the thickness of the case middle 1. This control rocker 16 is thus simultaneously in contact with the two pushers 4 and 5 in their rest positions defined by elastic return means, which in this example consist of the return spring with two arms 15, such that said rocker is alternately kinematically coupled with each of the pushers. When said rocker rocks in one or other direction into its two limit positions from its mid-position defined by the rest positions of the pushers 4, 5, it alternately moves these pushers 4, 5 into their respective sliding limit position.

When the chronograph mechanism is in the stop position, as illustrated by solid lines in the FIGURE, the user has a choice between two options: he can either actuate the control rocker 16 to rock it in the counterclockwise direction and thus restart the chronograph, should he wish to add up a plurality of time intervals, or actuate it in the clockwise direction and reset the chronograph mechanism to zero. By contrast, when the chronograph is in the position illustrated by broken lines, the user is not able to actuate the zero-reset pusher 5, blocked by the locking surface 14*d*, but only the start/stop pusher 4, in order to stop the counting operation.

As illustrated, the operating surface of the control rocker 16 preferably has a concave shape. This shape makes it possible, on the one hand, to provide better mating with the end of the finger used to operate it and, on the other hand, to increase the length of the lever arm on which the finger exerts its force.

The extreme simplicity of this control device can be seen, resulting in a substantial improvement in user comfort when using the control of the chronograph mechanism.

The invention claimed is

1. A pusher device for controlling the start/stop and zero-reset functions of a chronograph mechanism from outside a watch case, comprising a case middle whose main face is traversed by a central opening for receiving a timepiece movement and which has two lateral guide openings, the axes of which are parallel to the plane of the central opening and through which two control pushers are mounted so that they can slide between two limit positions, elastic return means tending constantly to maintain these pushers in their outer limit positions with respect to said central opening, corresponding to their rest positions, and a control rocker mounted on the lateral face of the case middle and hinged about a pin perpendicular to the plane of said central opening and remote from a pusher which is kinematically linked to this rocker between said two limit positions, characterized in that the control rocker is situated between the pushers, the latter, when in the outer limit position, being simultaneously in contact with the control rocker while maintaining it in a mid-position between its rocking limit positions which respectively correspond to the movement of the pushers into their inner limit positions.

2. The device as claimed in claim 1, in which the hinge pin of the rocker is situated on a mid-line with respect to the two pushers, and said elastic return means comprise two elastic arms symmetrical with respect to this same mid-line and respectively acting on said pushers.

3. The device as claimed in claim 1, in which the operating surface of said rocker has a concave shape.

4. The device as claimed in claim 1, in which said rocker and its pivoting means are entirely situated outside the case middle.

5. The device as claimed in claim 1, in which sealing means are arranged between said pusher and said lateral guide opening.

6. The device as claimed in claim 2, in which the operating surface of said rocker has a concave shape.

7. The device as claimed in claim 2, in which said rocker and its pivoting means are entirely situated outside the case middle.

8. The device as claimed in claim 3, in which said rocker and its pivoting means are entirely situated outside the case middle.

9. The device as claimed in claim 6, in which said rocker and its pivoting means are entirely situated outside the case middle.

10. The device as claimed in claim 2, in which sealing means are arranged between said pusher and said lateral guide opening.

11. The device as claimed in claim 3, in which sealing means are arranged between said pusher and said lateral guide opening.

12. The device as claimed in claim 4, in which sealing means are arranged between said pusher and said lateral guide opening.

13. The device as claimed in claim 6, in which sealing means are arranged between said pusher and said lateral guide opening.

14. The device as claimed in claim 7, in which sealing means are arranged between said pusher and said lateral guide opening.

15. The device as claimed in claim 8, in which sealing means are arranged between said pusher and said lateral guide opening.

16. The device as claimed in claim 9, in which sealing means are arranged between said pusher and said lateral guide opening.

* * * * *